United States Patent [19]

Pauls

[11] 4,023,795

[45] May 17, 1977

[54] CROSS-COUNTRY SKI EXERCISER

[76] Inventor: Edward A. Pauls, Rte. 1, Box 615P, Excelsior, Minn. 55331

[22] Filed: Dec. 15, 1975

[21] Appl. No.: 640,496

[52] U.S. Cl. ..... 272/97; 272/69

[51] Int. Cl.[2] ..... A63B 69/18

[58] Field of Search ..... 272/97, 69, 70; 35/29

[56] References Cited

UNITED STATES PATENTS

| | | | |
|---|---|---|---|
| 1,766,089 | 6/1930 | Wood | 272/69 |
| 2,274,081 | 2/1942 | Mautin | 272/97 |
| 3,332,683 | 7/1967 | Rand | 272/69 X |
| 3,408,067 | 10/1968 | Armstrong | 272/97 X |
| 3,455,550 | 7/1969 | Hall | 272/97 |
| 3,475,021 | 10/1969 | Ruegsegger | 272/97 |
| 3,554,541 | 1/1971 | Seaman | 272/69 |
| 3,711,089 | 1/1973 | Reinhard | 272/97 |
| 3,711,090 | 1/1973 | Fiedler | 272/69 |
| 3,941,377 | 3/1976 | Lie | 272/69 X |

FOREIGN PATENTS OR APPLICATIONS

| | | | |
|---|---|---|---|
| 672,583 | 10/1963 | Canada | 272/69 |
| 366,230 | 1/1923 | Germany | 35/29 R |
| 384,019 | 12/1932 | United Kingdom | 272/69 |
| 416,105 | 9/1934 | United Kingdom | 272/69 |

*Primary Examiner*—Jerome Schnall
*Attorney, Agent, or Firm*—Dugger, Johnson & Westman

[57] ABSTRACT

A ski exerciser used for simulating the motions required in cross-country skiing on which a skier can practice and exercise under conditions substantially similar conditions to those encountered during cross-country skiing.

10 Claims, 8 Drawing Figures

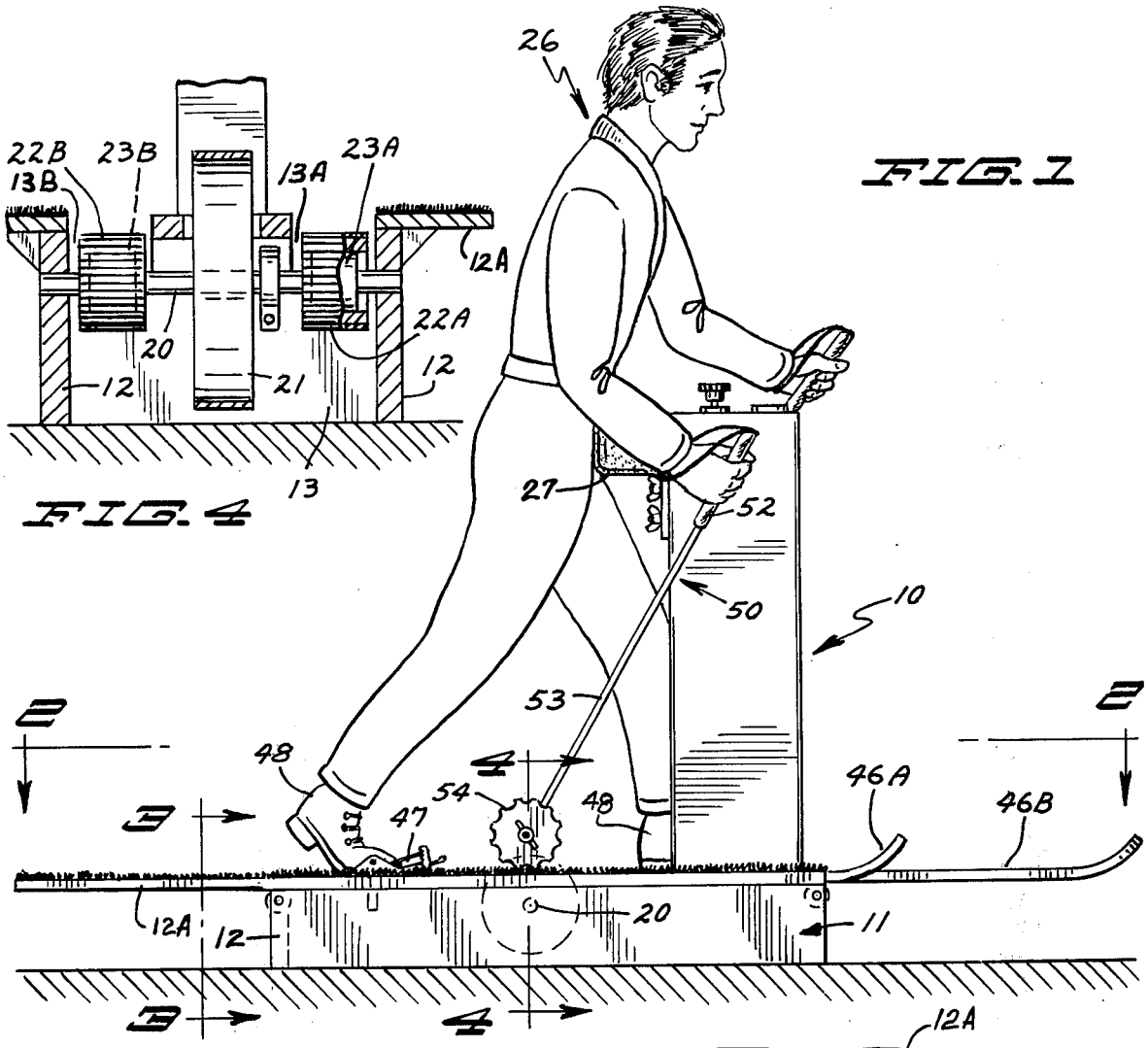
FIG. 1
FIG. 4
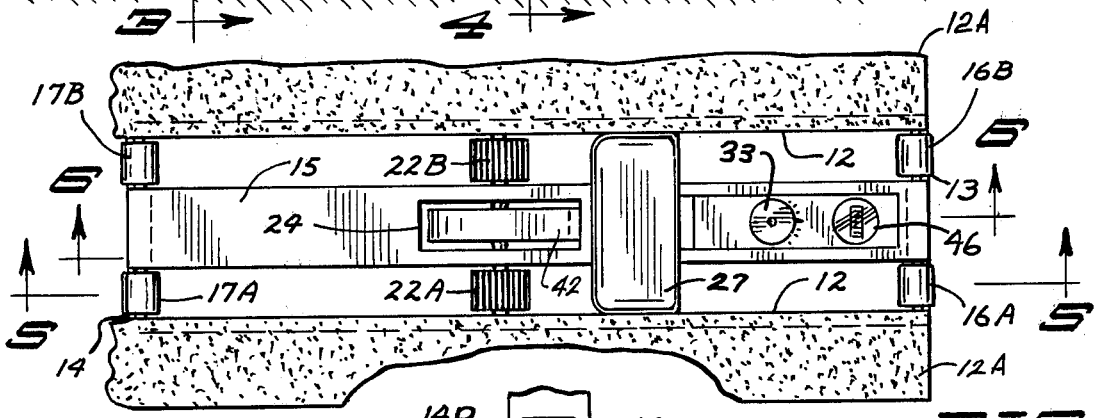
FIG. 2
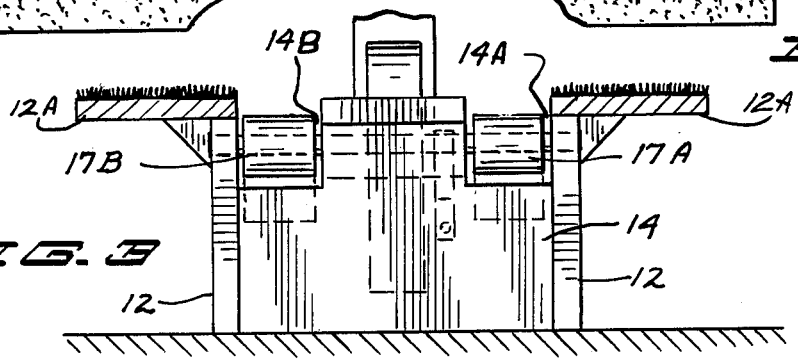
FIG. 3

FIG. 7
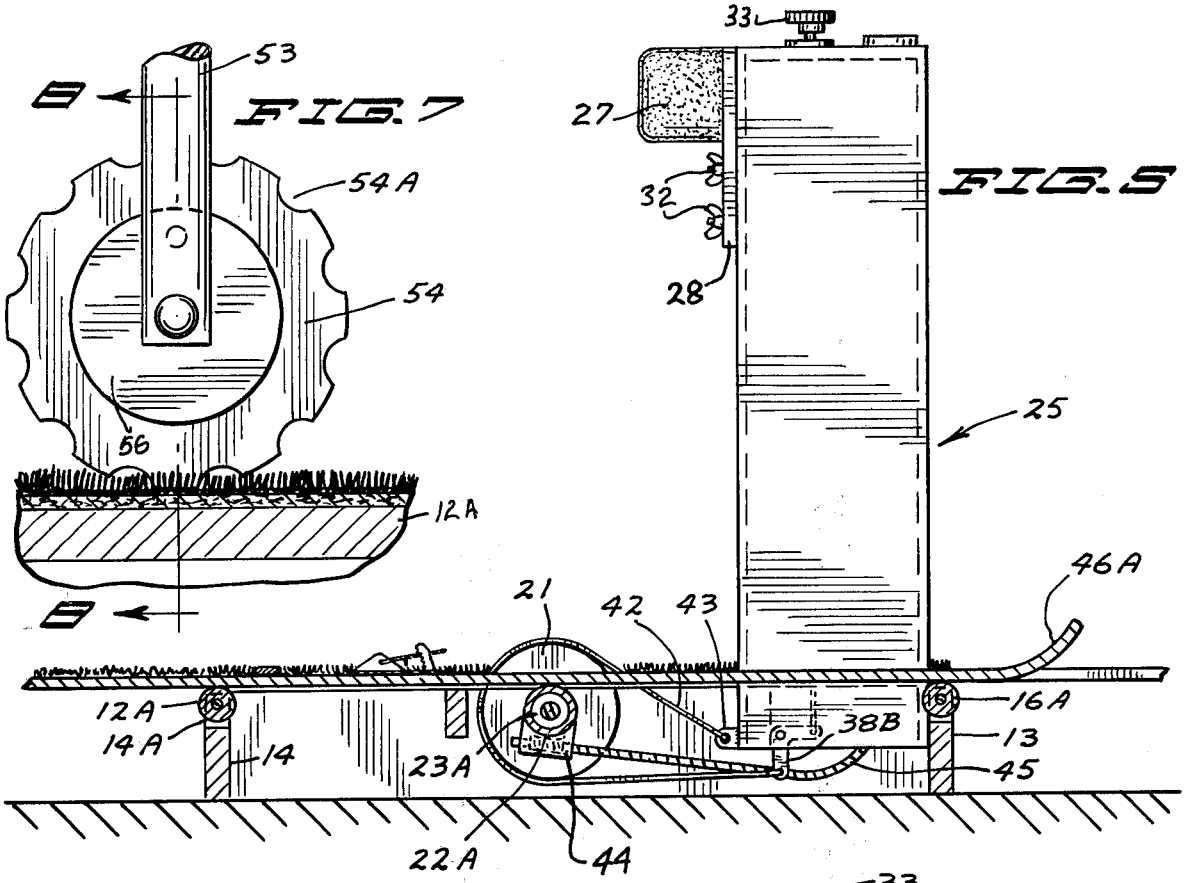
FIG. 5
FIG. 8
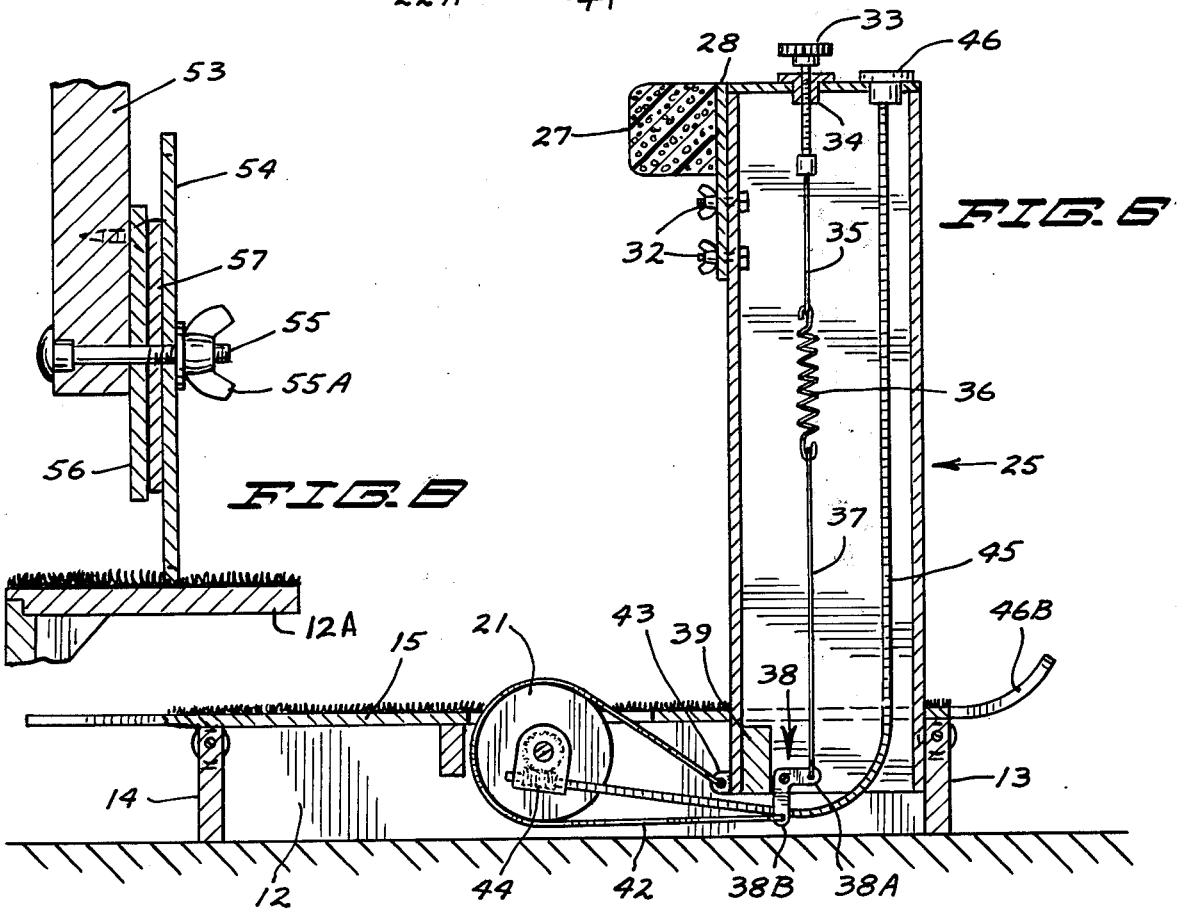
FIG. 6

CROSS-COUNTRY SKI EXERCISER

BACKGROUND OF THE INVENTION

1. Field of the Invention

The present invention relates to exercisers and simulators used for simulating the motions used during cross-country skiing.

2. Prior Art

In the prior art there are quite a large number of downhill skiing simulators or exercisers that are used by skiers during the off-season for getting in shape and also for practicing skiing techniques.

For example, U.S. Pat. No. 3,711,089 discloses a ski simulator that used a belt mounted over rollers, and in FIG. 5 through 9 of that patent, rollers which are not powered are shown. However, the action is different from that shown in the present device.

The present device does use a flywheel, and flywheels are shown in exercising devices, for example, in U.S. Pat. No. 2,274,081 where a flywheel is used to store energy, and also in U.S. Pat. No. 3,554,541, a flywheel is disclosed.

Other patents which show devices for simulating downhill skiing include U.S. Pat. Nos. 1,766,089; 3,408,067; 3,455,550; and 3,475,021.

SUMMARY OF THE INVENTION

The present invention relates to a simulator device or exerciser that simulates the motions encountered in cross-country skiing and permits a skier to use the device for exercising under simulated cross-country skiing conditions. The device includes a framework that is large enough to accommodate a person wearing cross-country skis, and the skis in turn are supported on individual drive means that have one-way drive means so that they will free wheel in one direction and will drive an energy storage device when moved in the opposite direction. In the form disclosed the energy storage device comprises a flywheel that has a brake band engaging its surface to dissipate energy as heat. The one-way drive means comprise one-way clutches, as shown driving a shaft by motion of the skis. In cross-country skiing, as opposed to downhill skiing, the skis are used for propulsion over the ground, and resistance to rearward movement of each leg permits the skier to move the other ski forward. Thus, in the device shown, on the backward thrust of each leg an individual roller driven by that ski will drive the energy storage unit in accordance with the amount of force provided by the person using the exerciser. Then, when that leg is moved forward, the roller will free wheel with little or no drag, just as is done when a cross-country skier moves a ski forward.

Restraint means are provided for restraining the movement of the skier relative to the frame so that the exerciser comprises an in-place exercising unit. In addition, for use with the exercise, cross-country ski poles having rotatable discs or wheels at the lower end are used, and the discs are frictionally mounted to simulate, also, resistance of the snow encountered during skiing.

Suitable supports are provided on the framework for stability, and if desired, a speedometer can be driven to indicate the speed with which the skier is moving. The energy absorbing device comprising a brake member and a flywheel in this form of the invention, can be adjusted to regulate the force required during operation so that different conditions can be simulated, such as, for example, simulating skiing on level, and simulating skiing going up a hill.

The device is manufactured out of standard existing mechanical components arranged in such a way that the simulation of cross-country skiing is accomplished easily, and fairly exactly. The restraint for the skier is shown as a forward restraint against which the skier leans, but it also can be a restraint such as a belt which was fastened to a wall or other support to the rear of the skier.

BRIEF DESCRIPTION OF THE DRAWINGS

FIG. 1 is a side elevational view of a cross-country simulator made according to the present invention;

FIG. 2 is a top plan view of the device of FIG. 1 taken as on line 2——2 of FIG. 1;

FIG. 3 is an end view taken as on line 3——3 of FIG. 1;

FIG. 4 is a sectional view taken as on line 4——4 in FIG. 1;

FIG. 5 is a sectional view taken as on line 5——5 of FIG. 2;

FIG. 6 is a sectional view taken as on line 6——6 in FIG. 2;

FIG. 7 is a fragmentary side view of the lower portion of the ski pole illustrated in FIG. 1; and FIG. 8 is a sectional view taken as on line 8——8 of FIG. 7.

DESCRIPTION OF THE PREFERRED EMBODIMENT

The ski exerciser illustrated generally at 10 inches a main frame 11. The frame 11 is made up of lateral side members 12, 12 which extend in a fore and aft direction, and are spaced apart a sufficient distance to approximate the space required for a normal skiing path for a cross-country skier. The frame members 12, 12 are held together with a front cross piece 13, and a rear cross piece 14. A longitudinally extending central support assembly 15 may also be provided and the assembly 15 connects between the cross pieces 13 an 14.

There are lateral supports 12A on opposite sides of the frame to provide surfaces for supporting the ends of the ski poles used, as will be explained.

The center assembly 15 is made so that it leaves laterally spaced tracks on opposite sides thereof and between the center member and the side frame members 12, 12.

As shown, the front and rear supports 13 and 14 are both recessed or notched, as perhaps best seen in FIG. 3, and these recesses indicated in FIGS. 3 and 4 at 13A, 13B and at 14A and 14B are used for rotatably mounting front idler rollers 16A and 16B, and rear idler rollers 17A and 17B.

These rollers 16 and 17 are idlers that may be covered with suitable elastomeric or soft plastic material that gives a reasonably high coefficient of friction, and reduces noise of skis that might be run over them.

In approximately the center of the frame in a longitudinal direction, there is a cross shaft 20 rotatably mounted between the side members 12, 12. The shaft 20 may be supported with respect to the center assembly 15, but is below the top plane thereof. This cross shaft 20 has a flywheel member 21 drivably mounted thereon with a suitable key, and on opposite sides of the center member 15, there are drive roller assemblies 22A and 22B, respectively, mounted to the shaft 20.

The roller assemblies 22 are connected to the shaft 20 through one-way clutches which are illustrated only schematically at 23A and 23B. The one-way clutches can be any desired type of one-way clutch which permits the rollers to drive the shaft 20, individually, but only when the rollers are driven in one direction. As shown, when the one-way clutches are installed so that when the rollers are driven in a counter-clockwise direction as viewed in FIGS. 1, 5 and 6, the individual rollers 22A and 22B will tend to drive the shaft 20 in such counter-clockwise direction. However, when the rollers are moved in clockwise direction as viewed in these figures, the rollers will free wheel and not drive the shaft. Thus, the one-way clutches 23A and 23B provide free wheeling action when the rollers are moved clockwise. Other suitable one-way drive means can be utilized if desired, but the commercially available clutches make a convenient assembly.

The upper part of flywheel 21 extends upwardly through a provided opening 24 in the center support member 15, and it should be noted that the upper edges of the rollers 22A and 22B are generally along the same plane as the corresponding rollers 16A and 17A, and 16B and 17B, respectively. This can be perhaps best seen in FIG. 5. The rollers 22A and 22B may be covered with suitable noise reducing, high friction elastomeric material, or other suitable material.

The center support member 15 also is used for mounting an upright pedestal illustrated generally at 25. The pedestal 25 comprises a box-like structure having upright side support members, and fore and aft members enclosing it. This pedestal is used to provide a restraint for the skier who is illustrated generally at 26. The skier restraint, in this form of the invention, is through a vertically adjustable foam cushion pad 27 that is adjustably mounted to the rear wall of the upright member 25 through the use of the slots in the walls of the upright member and in a bracket 28 that is attached to the foam pad 27. Suitable adjustments screws 32 can be provided for adjusting the bracket 28 relative to the pedestal 25.

The pedestal 25 is hollow, as shown in FIG. 6, and on the interior of the pedestal 25 a hand screw indicated at 33 is mounted at the top, and is threadably mounted through a nut 34 that is attached to the top of the pedestal. The hand screw in turn controls a cable 35 acting through a spring 36 which in turn is connected to another cable 37 that is attached to a leg 38A of a bell crank 38 that is pivotally mounted to a block 39 at the lower portion of the pedestal 25. The bell crank 38 has a second leg 38B that has one end of a flexible brake band 42 pivotally connected thereto. The brake band 42 passes around the periphery of the flywheel 21, as shown perhaps best in FIG. 6, and is anchored back at a fixed anchor point comprising an ear 43 that is attached to the pedestal 25 below the center member 15.

It can be seen that any force exerted through the spring 36 on the bell crank 38 will tend to tighten the flexible brake band 42 against the flywheel and tend to increase the friction drag on the flywheel.

Additionally, a gear unit indicated generally at 44, and of suitable design, can be mounted to be driven by a gear on the shaft 20 to drive a speedometer cable 45 which drives a speedometer-odometer indicator 46 calibrated to show speed of the movement of the skier, as well as the total simulated miles that have been skied.

When the exerciser is to be used, the skier 26 will put on a pair of cross-country skis indicated at 26A and 46B. Suitable bindings 47 will be used, and these will be the normal cross-country bindings. Also, the skier can use boots 48 of normal design. The skier will then place the skis in position so that ski 46A is resting on rollers 16A, 22A, and 17A, and ski 46B is resting on rollers 16B, 17B and 22B.

The skier then will use a pair of ski poles for stability. These ski poles are illustrated generally at 50, and are supported by lateral supports 12A. The skier will rest against the foam block 27, or other suitable restraint that might be provided, such as a belt anchored to the wall of a building in which the simulator can be used, and will just commencing moving his feet in much the same manner as is done in skiing. It can be seen that when the ski is thrust to the rear, for example, ski 46A, which has been moved rearwardly in FIG. 1, the ski bottom will engage the surface of the roller 22A and because the roller will then tend to be driven in counter-clockwise direction, the one-way clutch 23A will drive the shaft 20. This will tend to rotate flywheel 21, storing the energy that is expended by the rearward movement of the skier's leg, and any movement of course will be resisted by the friction between the brake band 42 and the outer surface of the flywheel. Then, the skier will move the opposite or left leg rearwardly, while the right leg is moved forwardly. The movement forwardly will cause the roller 22A to free wheel, much as is done during skiing operation, while the left leg will tend to drive roller 22B in counter-clockwise direction thereby acting through the one-way clutch 23B to drive the shaft 20 further. The free wheeling action will require that the skier move the legs to rotate rollers 22 faster than shaft 20 before the rollers will drive the shaft.

The operation is merely continued, and the amount of force or energy expended tending to rotate the flywheel can be changed by adjusting the hand wheel 33 to increase the drag (or decrease the drag) of the brake band 42 through the operation of the bell crank 38.

When skiing cross-country, ski poles are used for stability and also for added thrust. In the present device, the simulation of the use of the ski poles is desired, and in the form shown, the ski poles 50 are made in a special way. The ski poles have handles 52 of conventional design on the ski pole shafts 53, that are of the desired length for the user, and at the lower end of the shaft 53, a notched or toothed disc 54 is rotatably mounted onto a bolt 55 that passes through the shaft, and through a support disc 56, as well as through a friction disc 57. By tightening the bolt 55 through the use of a wing nut 55A, the amount of friction resisting rotation of the disc or wheel 54 can be changed. The disc 54 will be adjusted so that the frictional force will simulate the resistance encountered in normal snow conditions, and can be changed if desired to closely approximate the forces encountered during cross-country skiing. The disc 54 can be of any suitable material. The supports 12A are generally covered with carpeting to provide a suitable poling surface.

The platform 12A on each side of the frame can be eliminated if the ski poles are lengthened sufficiently so that they will run on the floor 51.

The exerciser provides means for exercising both arms and legs, when used with the provided poles. Complete exercise is achieved, and because it closely simulates actual conditions cross-country racers can use it to stay in shape in period of no snow.

The flywheel can be eliminated if a suitable friction device or other energy dissipation device is provided instead of the flywheel. For satisfactory operation there should be means to exert a desired amount of resistance for simulated skiing when the skis are moved in one direction.

What is claimed is:

1. An exerciser for simulating cross country skiing comprising a frame having first and second ends, support means on said frame and within the peripheral dimensions thereof for supporting a pair of skis, said support means comprising first and second freely rotatable roller means for each of said skis rotatably mounted adjacent the first and second ends of said frame, respectively, said first and second roller means for each of said skis being spaced apart in longitudinal direction but simultaneously engageable by skis worn by a user of the exerciser, and separate drive roller means for each of said skis at center portions of said frame and positioned between the respective first and second freely rotating rotatable roller means, said separate drive roller means for each of said skis being substantially midway between the first and second freely rotating rotatable roller means for the respective skis, a shaft member rotatably mounted on said frame, both of said separate drive roller means being mounted on said shaft, one way clutch means mounting each of said separate drive roller means to said opposite ends of said shaft, a flywheel drivably mounted on said shaft, whereby movement of each of a pair of skis supported on their respective roller means will cause the respective drive roller means to rotate said flywheel in one direction and each of said drive roller means being free wheeling in the opposite direction from said one direction whereby energy imparted to each of said drive roller means is stored in a common flywheel.

2. The combination of claim 1 and means to restrain a person moving said skis when in position on said frame.

3. The combination as specified in claim 1 wherein said means to restrain comprises an upright pedestal mounted at the forward portions of said frame, and means to engage a portion of a skier's body to restrain forward movement.

4. The combination as specified in claim 1 and friction brake means for frictionally restraining motion of said flywheel.

5. The combination as specified in claim 4 and means to adjust the frictional force said friction band means exerts on said flywheel.

6. The combination as specified in claim 5 wherein said means to adjust the frictional force comprises a bell crank member pivotally mounted to said frame, said bell crank member having a first arm, means to mount one end of said friction band on said first arm, means to mount the other end of said friction band to said frame, said bell crank having a second arm, and means to adjustably exert a resilient force on said second arm tending to pivot said bell crank means to tighten said friction band against said flywheel.

7. The combination as specified in claim 1 and speedometer means drivably mounted to said shaft.

8. The combination of claim 1 wherein said flywheel is mounted at the midportion of said shaft and between the separate drive roller means.

9. An exerciser device for simulating cross country skiing comprising a frame member having first and second ends, a plurality of rollers on said frame positioned to individually each support, a pair of skis along adjacent opposite sides of said frame, one ski in each of a pair of first and second roller paths, at least one of said rollers in each of said roller paths comprising a drive roller, each of said drive rollers being rotated upon movement of a ski engaging said drive roller, flywheel means rotatably mounted on said frame for storing energy developed by driving said drive rollers, means to drivably connect the drive rollers in each path to said flywheel means including one way clutch means, said one way clutch means being effective to disengage driving connection between each of said drive rollers and when said drive rollers are rotated in one direction of rotation and to effect driving connection between said drive rollers and the flywheel means when said drive rollers are rotated in the other direction at a speed greater than the speed necessary to overtake the rotation of the flywheel means.

10. The combination of claim 9, wherein said rollers for each ski form a separated path from the roller means for the other ski, means on said frame forming a divider between said separated paths, an upright pedestal mounted on said divider means extending upwardly from said frame in a position ahead of the position assumed by a skier using said exerciser, and barrier means mounted on said pedestal and engaging portions of a body of a user adjacent the hip area of the user to restrain the user from forward movement during use of said exerciser.

* * * * *

UNITED STATES PATENT AND TRADEMARK OFFICE

CERTIFICATE OF CORRECTION

PATENT NO. : 4,023,795

DATED : May 17, 1977

INVENTOR(S) : Edward A. Pauls

It is certified that error appears in the above-identified patent and that said Letters Patent are hereby corrected as shown below:

Column 1, line 58 "exercise" should be--exerciser--. Column 2, line 33 "inches" should be--includes--; Column 2, line 42 "an" should be--and--. Column 4, line 2 "26A" should be--46A--. Column 6, line 22, (Claim 9, line 4), before support remove "each" after support remove the comma "(,)" and insert--each of--; Column 6, line 35, (Claim 9, line 17), after rotation insert a comma --(,)--; Column 6, line 40, (Claim 10, line 1), after "9" take out the comma --,--; Column 6, lines 41 and 42, (Claim 10, lines 3 and 4), "roller means" should be--rollers--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*